United States Patent [19]

Hartley, II

[11] 4,436,597

[45] Mar. 13, 1984

[54] METHOD AND APPARATUS FOR PRODUCING ALUMINUM IN AN ELECTROLYSIS CELL WITH QUARRY TILE LINING

[75] Inventor: Louis A. Hartley, II, New London, N.C.

[73] Assignee: Aluminum Company of America, Pittsburgh, Pa.

[21] Appl. No.: 334,896

[22] Filed: Dec. 28, 1981

[51] Int. Cl.[3] ..... C25C 3/06; C25C 3/08

[52] U.S. Cl. ..... 204/67; 204/213 R; 204/215

[58] Field of Search ..... 204/67, 243, 245

[56] References Cited

U.S. PATENT DOCUMENTS 3,629,079 12/1971 Bristol ..... 204/67

3,855,086 12/1974 Sleppy et al. ..... 204/67

FOREIGN PATENT DOCUMENTS 461972 9/1975 U.S.S.R. ..... 204/243 R

*Primary Examiner*—Howard S. Williams

*Attorney, Agent, or Firm*—Daniel A. Sullivan, Jr.

[57] ABSTRACT

In the electrolytic production of aluminum, in a cell having a side wall including a layer of carbon electrically insulated from a jacket of metal, the improvement including interposing a layer of tile (27) between the carbon layer (23,24) and the metal jacket (28).

7 Claims, 1 Drawing Figure

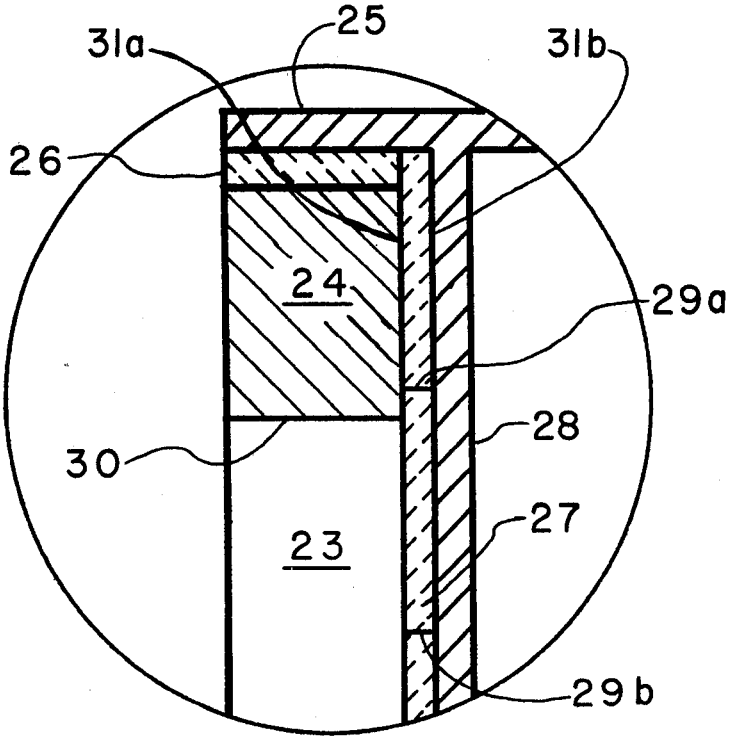
25
31a
31b
26
24
29a
28
30
27
23
29b

METHOD AND APPARATUS FOR PRODUCING ALUMINUM IN AN ELECTROLYSIS CELL WITH QUARRY TILE LINING

BACKGROUND OF THE INVENTION

The present invention relates to the lining of a cell for the electrolytic production of aluminum.

SUMMARY OF THE INVENTION

An object of the invention is to provide a new and improved process and cell for the electrolytic production of aluminum.

This as well as other objects which will become apparent in the discussion that follows are achieved according to the present invention by providing, in the electrolytic production of aluminum, in a cell having a side wall including a layer of carbon electrically insulated from a jacket of metal, the improvement comprising interposing a layer of tile between the carbon layer and the metal jacket.

BRIEF DESCRIPTION OF THE DRAWING

The sole FIGURE of the drawing is an elevational, cross-sectional view of a side wall portion of a cell for the electrolytic production of aluminum, the cutting plane for the cross section being along an edge of the illustrated graphite block.

DESCRIPTION OF THE PREFERRED EMBODIMENTS

Referring now in detail to the sole FIGURE of the drawing, it will be seen that a preferred cell for use in an embodiment of the present invention is similar to the Hall-Heroult-type cell shown in FIG. 1 of U.S. Pat. No. 3,852,173 in that graphite block 23 is used here as carbon block as was done in FIG. 1 of U.S. Pat. No. 3,852,173. In the present embodiment, another type of carbon block, anthracite block 24, is placed on top of the graphite. Anthracite block is cheaper than graphite block, and it is used in the upper part of the side wall, where the greater thermal conductivity and erosion resistance of graphite block is not needed.

Interposed between the top of the anthracite block 24 and the underside of the metal, e.g. steel, deck plate 25 is a layer of quarry tile 26.

According to an embodiment of the present invention, an upwardly extending layer of quarry tile 27 is interposed between the carbon block and the metal, e.g. steel, jacket 28 of the cell. This quarry tile is held in place by a cement, e.g. silicon carbide mortar (not shown), at its joints 29*a*, 29*b* and at its interfaces 31*a*, 31*b* with jacket 28 and the carbon blocks.

It has been found that presence of tile 27 in a Hall-Heroult cell can permit electrolysis using a voltage across the cell at an average of at least 0.1 volts less than the average voltage for electrolysis in a cell without the tile.

EXAMPLE

Quarry tile 27 of the American Olean Tile Company, Lewisport, Kentucky, was installed in three cells in the manner shown in the FIGURE, using silicon carbide cement at the joints and at the interfaces. The average voltage across the three cells was 4.313 volts. This is to be compared with an average voltage of 4.448 volts for three similar cells in the same plant. Thus, an average savings of 0.135 volts per cell was realized.

The tile was referred to by the supplier as its standard grade quarry tile. The individual pieces measured $6\times6\times\frac{1}{2}$ inches thick. In a water absorption test according to ASTM C-20-70, such tile gives a percent water adsorption percentage between 0.5 and 0.6. In compression testing according to ASTM C-67-50, the tile shows a compressive crushing strength of between 25,000 and 30,000 psi. In thermal expansion testing according to ASTM C-372, a coefficient of linear thermal expansion is measured at a value of between $2.5\times10^{-6}$ inches per inch per degree Fahrenheit. In thermal conductivity testing according to ASTM C-177, a "K" factor is recorded between 3 and 5.

The silicon carbide cement was that of the Carborundum Company, Refractories Division, of Keasby, New Jersey, sold under the designation of Carbofrax No. 4 silicon carbide mortar/patch. Typically, this product will analyze 86.0% silicon carbide. The silicon carbide particle size is 36 mesh and finer. Maximum use temperature is around 3200° F.

The carbon blocks measured 4 inches in thickness and were provided at their joints 30 with C-38 cement (not shown) of the Union Carbide Corporation, Carbon Products Division, of Niagara Falls, New York. This product is conductive approximately to the extent of the carbon blocks, resists oxidation, and can maintain bonding at service temperatures to 1400° C. and above.

While the invention has been described in terms of preferred embodiments, the claims appended hereto are intended to encompass all embodiments which fall within the spirit of the invention.

What is claimed is:

1. In a process for the electrolytic production of aluminum, in a cell having a side wall including a layer of carbon electrically insulated from a jacket of metal, the improvement comprising interposing an upwardly extending layer of tile between the carbon layer and the metal jacket.

2. A process as claimed in claim 1, further comprising carrying out the electrolysis at an average voltage of at least 0.1 volts less than the average voltage for electrolysis without the tile.

3. A cell suitable for the electrolytic production of aluminum, said cell having a side wall including a layer of carbon electrically insulated from a jacket of metal, wherein the improvement comprises an upwardly extending layer of tile between the carbon layer and the metal jacket.

4. A cell as claimed in claim 3, further comprising cement between the tile and the carbon layer and between the tile and the metal jacket.

5. A cell as claimed in claim 4, said cement being silicon carbide cement.

6. A cell as claimed in claim 3, the carbon layer comprising blocks of carbon.

7. A cell as claimed in claim 6, said blocks comprising graphite.

* * * * *

UNITED STATES PATENT AND TRADEMARK OFFICE

CERTIFICATE OF CORRECTION

PATENT NO. : 4,436,597

DATED : March 13, 1984

INVENTOR(S) : Louis A. Hartley

It is certified that error appears in the above-identified patent and that said Letters Patent are hereby corrected as shown below:

| | |
|---|---|
| In the Title | Delete "Quarry". |
| Col. 2, line 15 | After "$2.5 \times 10^{-6}$" insert --$3 \times 10^{-6}$--. |

Signed and Sealed this

*Twelfth* Day of *June 1984*

[SEAL]

*Attest:*

GERALD J. MOSSINGHOFF

*Attesting Officer*

*Commissioner of Patents and Trademarks*